US006334282B1

(12) United States Patent
Wood

(10) Patent No.: US 6,334,282 B1
(45) Date of Patent: Jan. 1, 2002

(54) DEVICE FOR COVERING WINDOWS AND DOORS DURING SEVERE STORMS

(76) Inventor: Herman C. Wood, 55 Prairie Dawn Cir., Conroe, TX (US) 77385

( * ) Notice: Subject to any disclaimer, the term of this patent is extended or adjusted under 35 U.S.C. 154(b) by 0 days.

(21) Appl. No.: 09/836,301

(22) Filed: Apr. 17, 2001

(51) Int. Cl.[7] ..... E06B 3/26

(52) U.S. Cl. ..... 52/202; 52/203; 52/106; 52/107; 52/507; 49/57; 49/463; 49/50; 49/61; 49/62; 49/465; 292/149; 292/137; 292/165; 292/332; 292/336; 292/220; 292/195; 292/210

(58) Field of Search ..... 52/202, 106, 107, 52/507, 203; 49/57, 463, 50, 61, 62, 465; 292/149, 137, 165, 332, 336, 220, 195, 210

*Primary Examiner*—Carl D. Friedman
*Assistant Examiner*—Chi Nguyen
(74) *Attorney, Agent, or Firm*—Mary J. Gaskin

(57) ABSTRACT

A device is provided for protecting a window or door during severe storms. A panel, cut to fit in a window frame, is held in place by the action of the locking assemblies described herein. A rubber gasket can be used along on e side of the panel in place of some of the locking assemblies. Different embodiments of the assembly are described for mounting along the sides of the panel. A "clip-on" assembly is also described.

15 Claims, 10 Drawing Sheets

DEVICE FOR COVERING WINDOWS AND DOORS DURING SEVERE STORMS

RELATED APPLICATION DATA

The disclosure is related to co-pending U.S. patent application, Ser. No. 09/568,487, which was filed on May 10, 2000.

FIELD OF THE INVENTION

The present invention relates to a device for protecting windows and doors from breakage and damage during severe storms, including hurricanes.

BACKGROUND OF THE INVENTION

Presently, home and business owners who seek to minimize the damage caused by severe storms have few options for protecting windows and doors. Two of these options are very expensive and require time-consuming installation. One such option requires the removal of the pre-existing window and frame and replacement with a storm window having a frame with a slot for the insertion of a properly-sized piece of plywood. Another such option requires the installation of a storm shutter for each window, either a hinged shutter or a metal shield which is unrolled to cover the window. Many of the other devices for protecting windows require making holes in the window frame for insertion of braces or anchors. Some are cumbersome or difficult to install.

The least expensive option is buying and cutting pieces of plywood and nailing a piece of plywood over each window. However, after the storm has passed, the removal of the plywood leaves nail holes behind. Finally, some people simply apply tape to windows so that glass shards are not blown everywhere if the windows break during a storm. Needless to say, tape offers little or no protection from the storm itself.

A need presently exists for an inexpensive device which can be installed on short notice, without pre-installation, nailing, or screwing.

SUMMARY OF THE INVENTION

The present invention overcomes the disadvantages of existing options for protecting windows and doors during violent storms. The window covering devices herein disclosed can be easily installed, on short notice. They can be used over and over again, leaving no nail or screw holes in window frames.

The locking assemblies can be sold in hardware stores. The plywood or other material is sold separately. (Plywood can be used from previous storm alerts). The panels that will cover the windows do not need to be cut precisely to size; they need only fit within one-half inch of the sill, head and sides of the window frame. Alternative embodiments of the locking assemblies are disclosed: one can be fastened to the wood with a wrench or pliers; another can be slipped over the edge of the panel, requiring no drilling or fastening.

A primary object of the present invention is to provide a window covering device which may be easily installed and removed.

Yet another object of the present invention is to provide a window covering device which can be assembled and installed by ordinary homeowners.

Still another object of the present invention is to provide a window covering device which can be installed in metal or brick frames, where nailing or screwing is not possible.

A further object of the present invention is to provide a window covering device which can be used on non-standard sized and shaped windows, as well as doors.

One more object of the present invention is to provide a window covering device which leaves no nail holes or screw holes in a window frame.

A still further object of the present invention is to provide an effective window covering device at a substantially lower cost than storm windows or shutters.

Several embodiments of the invention are described with reference to the following drawings.

DESCRIPTION OF THE PREFERRED EMBODIMENT

Figure 1:
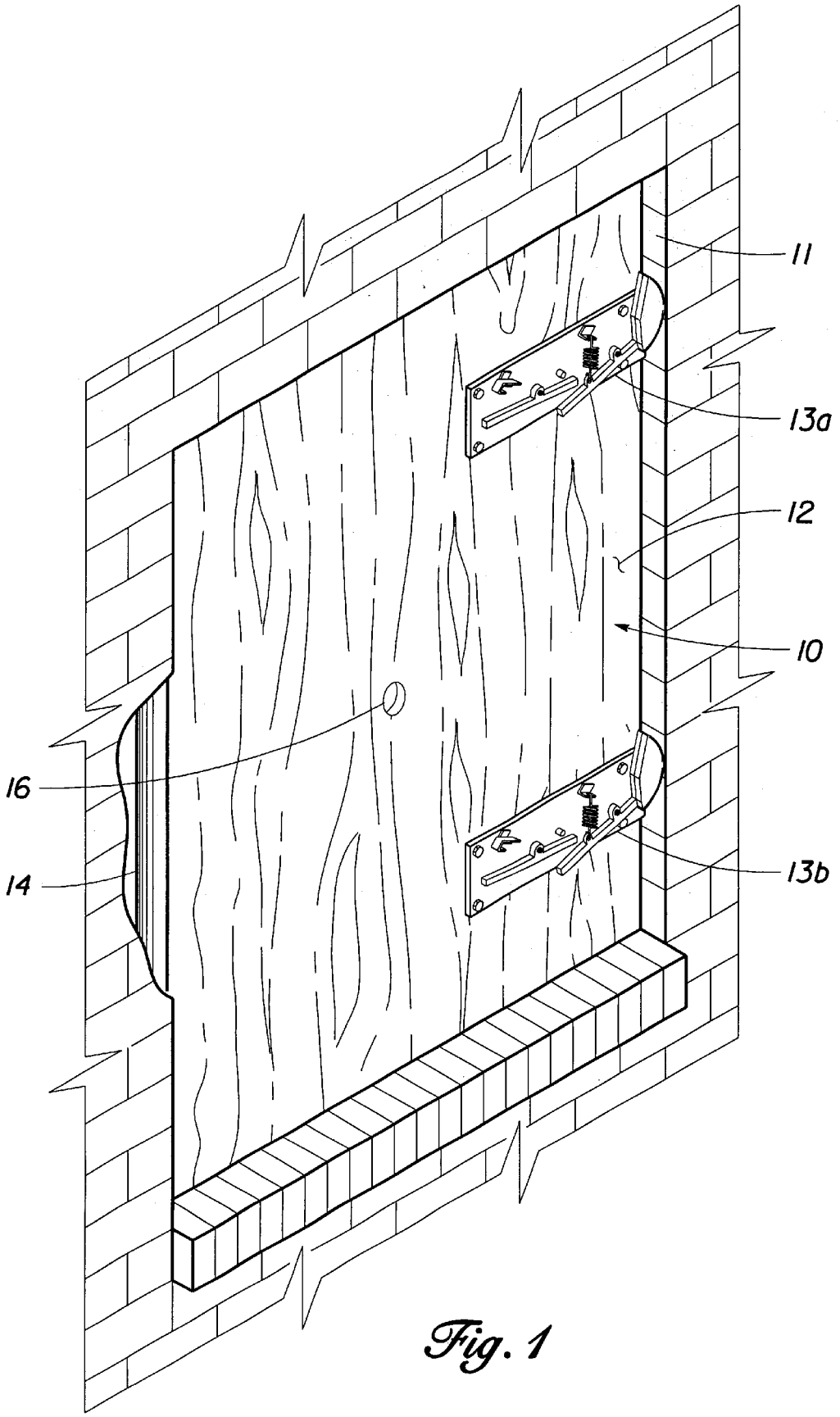
FIG. 1 is a perspective view of the window covering device installed in a window frame, with a pair of locking assemblies, according to the present invention.

In FIG. 1, a window covering device 10 has been installed inside a window frame 11 on the exterior-facing side of a window (not shown). The panel 12 has been precut (with up to one-half inch allowance on all sides) to fit inside the window frame 11, without forcing. The panel 12 can be formed from wood or another material that is rigid with some give, such as plexiglass, aluminum, or expanded metal grating. Leftover plywood which had been nailed over windows in previous storms can be used. A pair of locking assemblies 13*a*, 13*b* attached to the panel 12 hold it firmly in place within the window frame 11. The cutaway portion on the left shows the position of the gasket 14. Optionally, a small round hole 16 (approximately one-half inch in diameter) can be cut through the wood panel 12 to act as a finger grab for positioning the wood panel 12.

Figure 2:
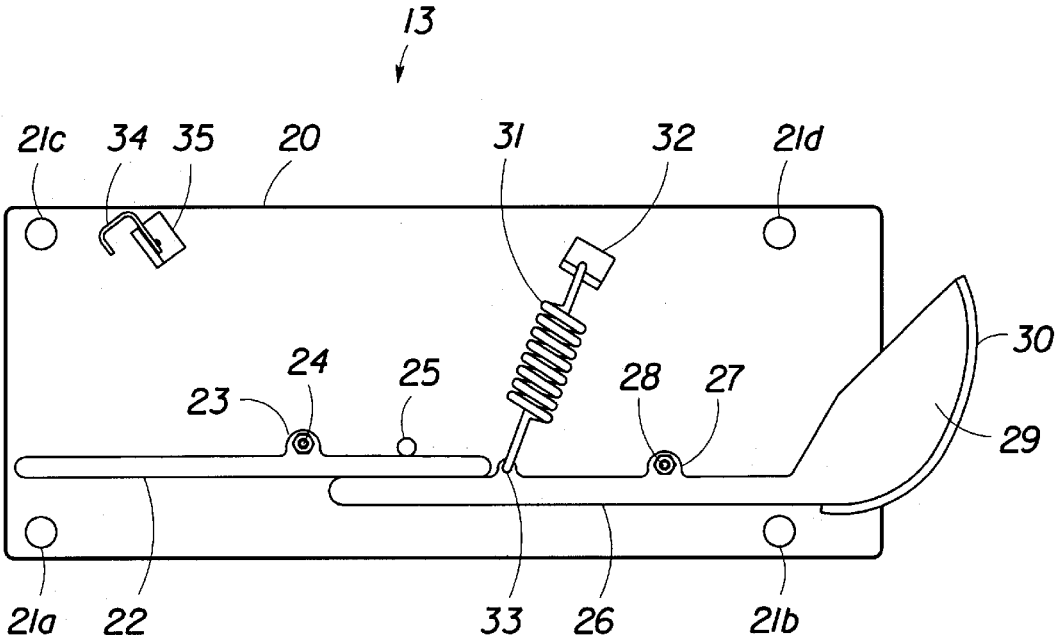
FIG. 2 is a top view of a single locking assembly, in an engaged position.

As shown in FIG. 2, the locking assembly 13 comprises a metal base plate 20 with fastener holes 21*a*, 21*b*, 21*c*, 21*d*; a metal lever arm 22 pivotally mounted on the base plate 20 at lever arm pivot point 23 with a fastener 24; a lever arm stop 25 positioned to keep the lever arm 22 from pivoting past a desired point; and an angled metal locking arm 26 pivotally mounted on the base plate 20 at locking arm pivot point 27 with a fastener 28. Attached to the curved end 29 of locking arm 26 is a rubber stopper 30. One end of a spring 31 is attached to a first bracket 32. The opposite end of the spring 31 is attached to the locking arm 26 at attachment point 33. A metal catch 34 is pivotally mounted onto a second bracket 35.

Figure 3:
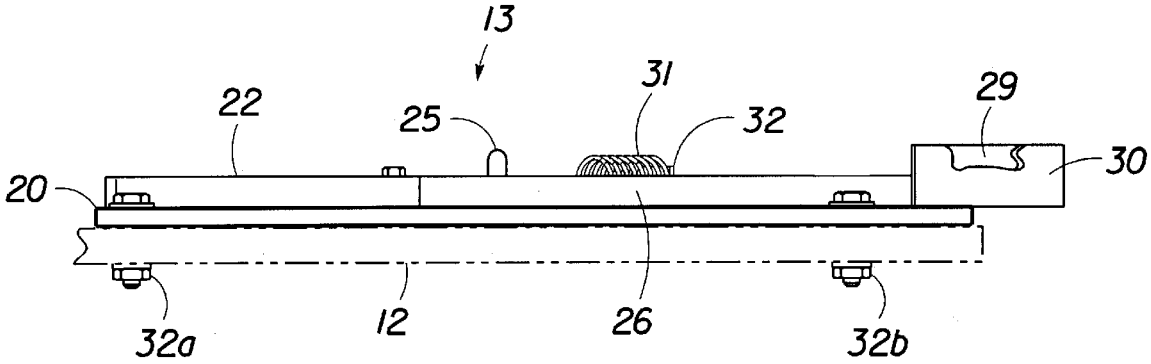
FIG. 3 is a side view of a single locking assembly installed on a wood panel.

As shown in FIG. 3, a locking assembly 13 has been fastened to a wood panel 12 with fasteners 32*a*, 32*b*, which have been inserted through fastener holes 21*a*, 21*b*. The fasteners 32*a*, 32*b* are typically bolts, but can be rivets or pins. Typically, two locking assemblies 13*a*, 13*b* are attached to one side of a wood panel 12 in a parallel relationship, as shown in FIG. 1. When engaged, the rubber stopper 30 of each locking assembly 13*a*, 13*b* extends over the side of the wood panel 12.

Figure 4:
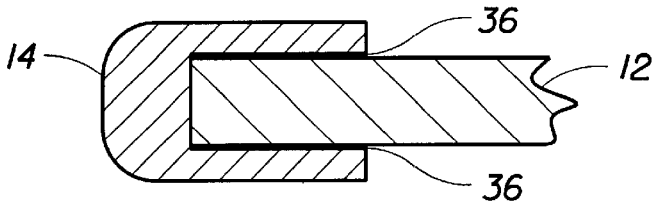
FIG. 4 is a horizontal section view of the gasket positioned on a side of a wood panel.

As shown in FIG. 4, a length of rubber edge gasket 14 is affixed to the edge of the wood panel 12 opposite that upon which the locking assemblies 13*a*, 13*b* are fastened. The rubber edge gasket 14 can be made from rubber or any rubberlike material, such as cork or foam. Typically, the gasket 14 is slid over the edge of the wood panel 12 and adhesive 36 is used to bond the gasket 14 to the wood panel 12.

Figure 5A:
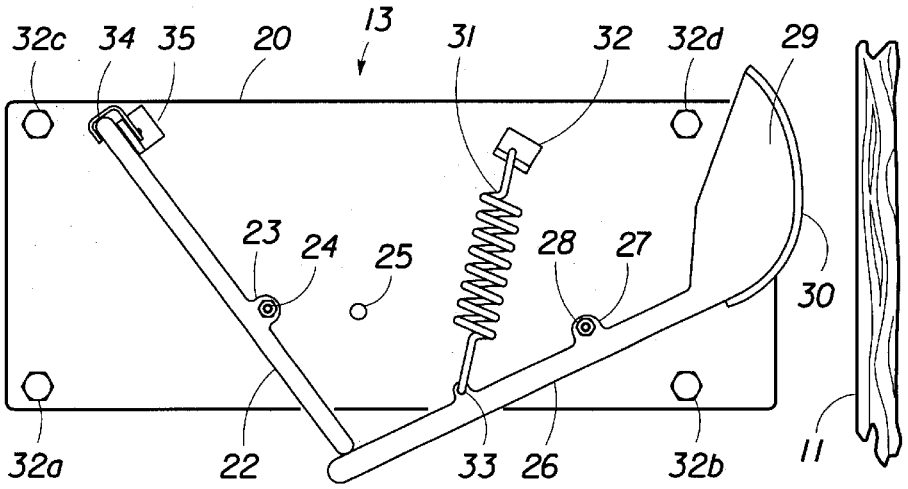
FIGS. 5A–C show views of the locking assembly as the arms are moved from a disengaged to an engaged position.
Figure 5B:
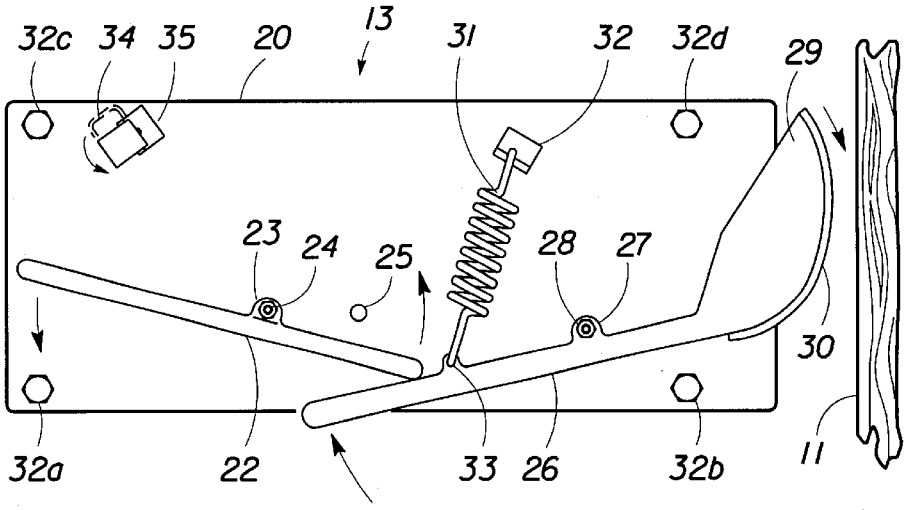
Figure 5C:
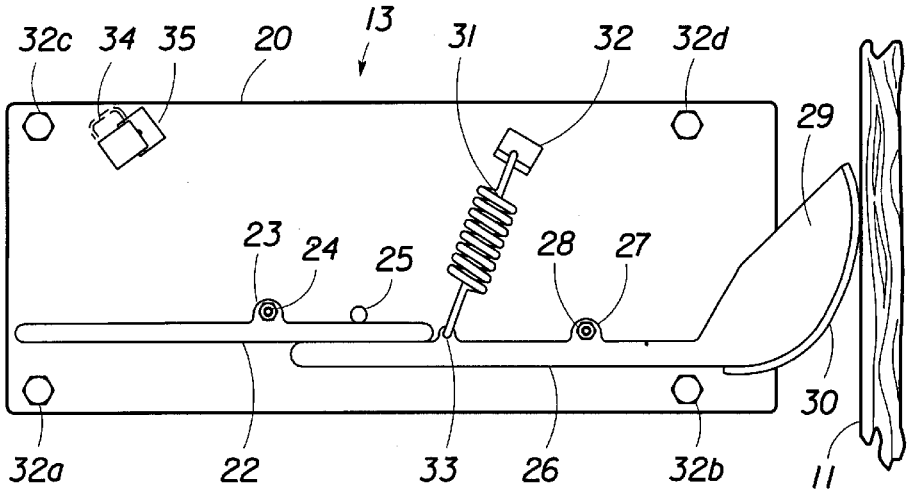

FIGS. 5A–5C show the operation of a locking assembly 13. In its unlocked position, shown in 5A, one end of the lever arm 22 abuts an end of locking arm 26. The pivoting of lever arm 22 has caused the locking arm 26 to pivot, stretching the spring 31. The opposite end of lever arm 22 has been inserted into catch 34, preventing further movement of either the lever arm 22 or the locking arm 26. The curved end 29 of the locking arm 26 and the rubber stopper 30 do not extend past the side of the base plate 20. In order to complete installation of the wood covering device 10 in a window frame 11, as shown in FIG. 1, the edge of the wood panel 12 having the gasket 14 is positioned on the left side of the window frame 11. The side of the wood panel 12 having the locking assemblies 13*a*, 13*b* is then pushed into place along the right side of the window frame 12.

As shown in FIG. 5B, the end of the lever arm 22 has been released from the catch 34, allowing it to pivot in the direction of the arrows about lever arm pivot point 23. As the lever arm 22 pivots, the contraction of spring 31 causes the locking arm 26 to pivot in the direction of the arrows about locking arm pivot point 27. The pivoting movement of the locking arm 26 causes the curved end 29 of the locking arm 26 to extend past the side of the base plate and contact the window frame 11.

FIG. 5C shows the locking assembly 13 in its final locked position. The lever arm 22 and the locking arm 26 are in parallel alignment, prevented from further spring-induced pivotal movement by stop 25. The rubber stopper 30 covering the curved end 29 presses firmly against window frame 11, and spring tension holds the window covering device 10 in place.

Removal of the panel 12 after a storm is quick and easy: the lever arm 22 of each locking assembly 13 is pivoted, causing the locking arm 26 to pivot, and causing the curved end 29 of the locking arm 26 to move away from the window frame 11; the rubber stopper 30 will no longer press against the window frame 11, and the panel 12 can be pulled out. The metal catch 34 holds the lever arm 22 in an unlocked position.

Figure 6:
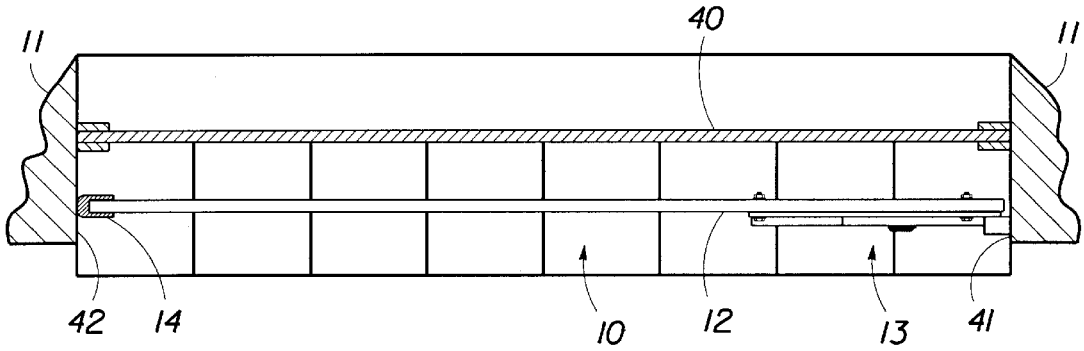
FIG. 6 is a horizontal section view of the window covering device, which someone outside a dwelling has installed in the window frame on the exterior-facing side of the window.
Figure 7:
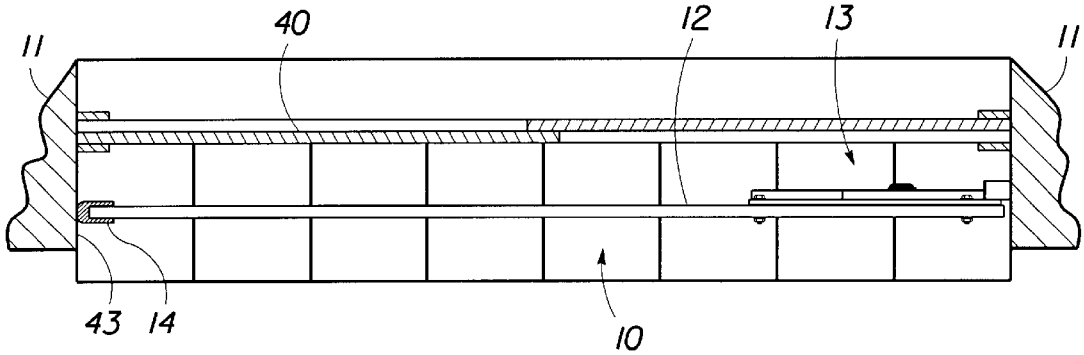
FIG. 7 is a horizontal section view of the window covering device which someone inside a dwelling has installed in the window frame on the exterior-facing side of the window.
Figure 8:
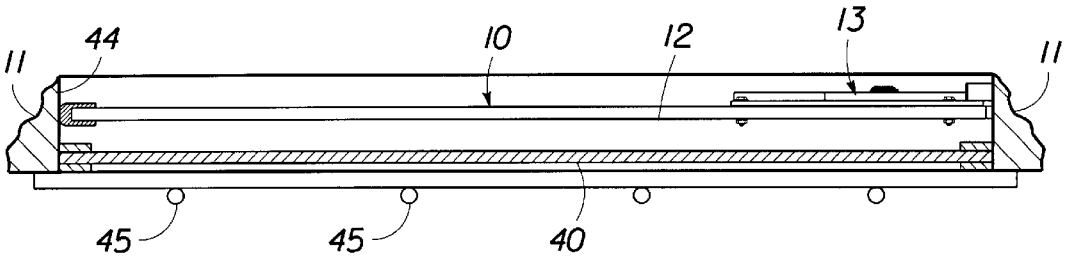
FIG. 8 is a horizontal section view of the window covering device which has been installed in the window frame on the interior-facing side of a window which has pre-existing burglar bars.

FIGS. 6, 7, and 8 show alternate choices for installation.

In FIG. 6, the window covering device 10 has been installed in the window frame 11 on the exterior-facing side of a window 40. Each locking assembly 13 pushes against the right side 41 of the frame 11, while the rubber gasket 14 pushes against the left side 42 of the frame 11.

To accomplish the installation shown in FIG. 7, the window must first be opened. Someone inside a dwelling can slip the window covering device 10 through the window 40 and rest the gasket 14 against the outer window frame 43 on the exterior side of the window 40.

As shown in FIG. 8, the window covering device 10 can also be installed on the inner window frame 44 on the interior side of a window 40 if, for instance, burglar bars 45 are present, the window 40 does not open, or the exterior side of the outer window frame 43 is inadequate to hold the window covering device 10 in place. While this installation choice does not protect the window glass, it affords protection from flying debris' entering the dwelling, and from theft or looting.

Figure 9:
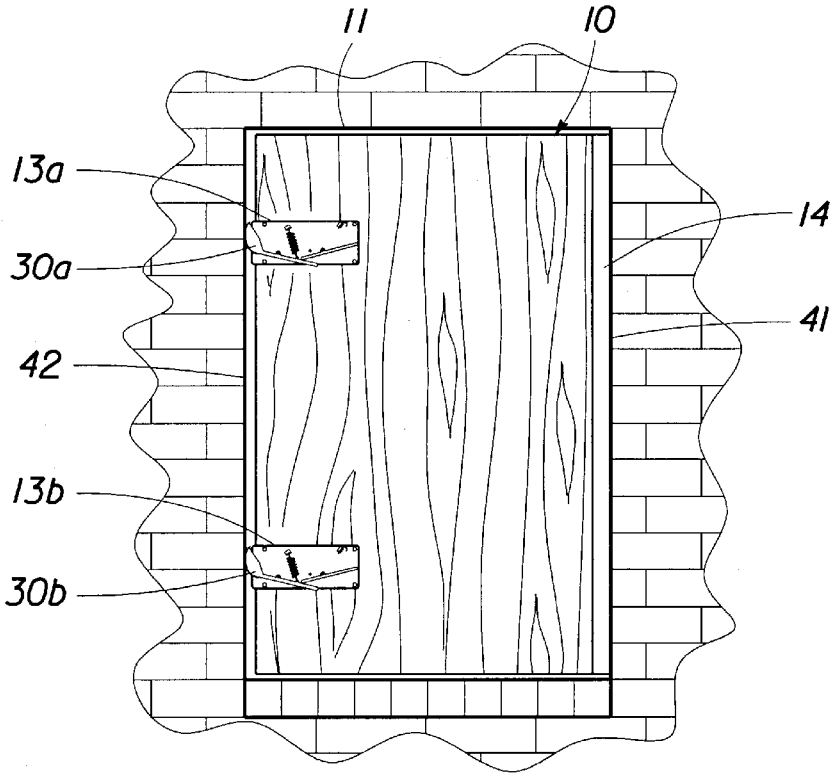
FIG. 9 is a plan view showing a preferred mounting configuration of the window covering device, with the locking assemblies installed on the left side of the window.

As FIG. 9 shows, the window covering device 10 can be installed within the window frame 11 with the rubber gasket 14 pushed against the right side 41 of the frame and the rubber stoppers 30*a*, 30*b* of the locking assemblies 13*a*, 13*b* pushed against the left side 42 of the frame.

Figure 10:
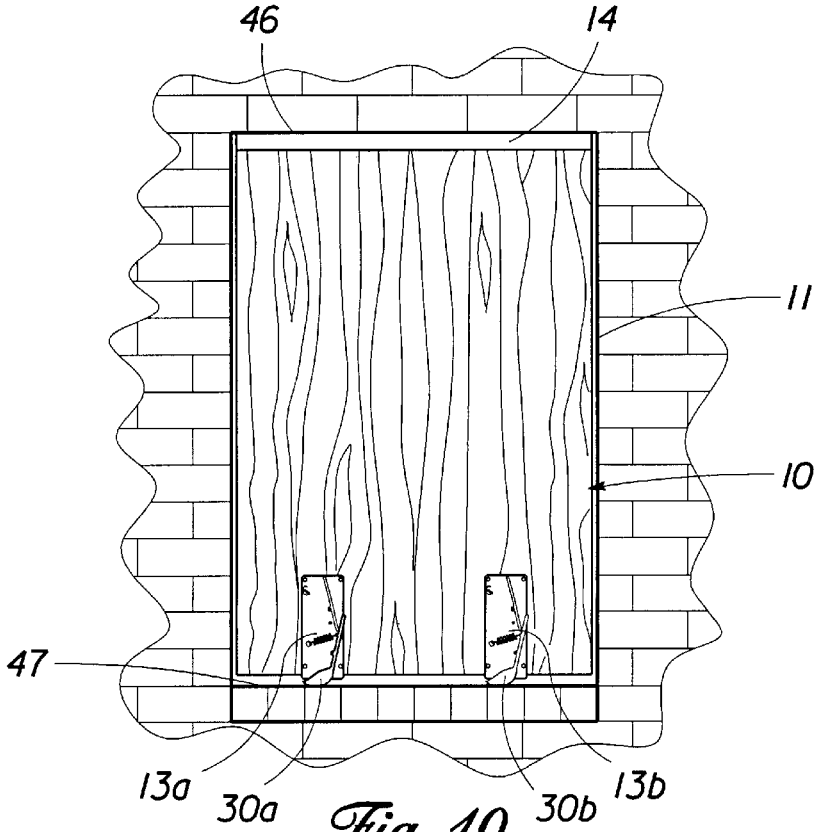
FIG. 10 is a plan view showing an alternate mounting configuration of the window covering device, with the locking assemblies installed on the bottom of the window.

As FIG. 10 shows, the window covering device 10 can also be installed with the rubber gasket 14 pushed against the head 46 of the frame, and the rubber stoppers 30*a*, 30*b* of locking assemblies 13*a*, 13*b* pushed against the sill 47 of the frame.

Figure 11:
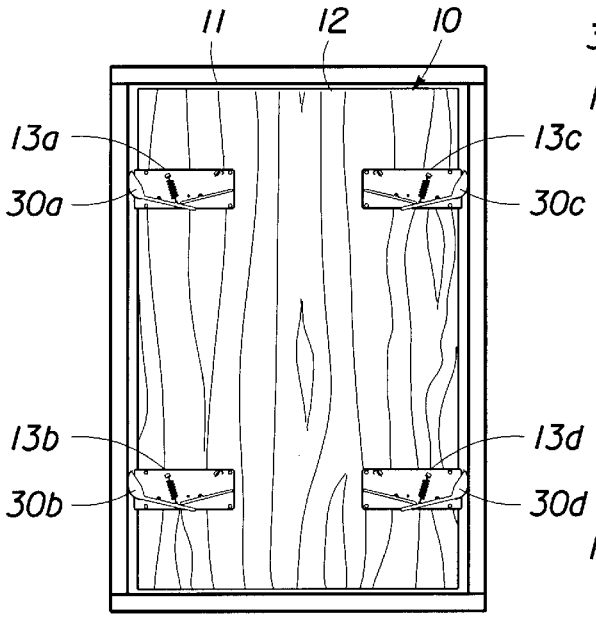
FIGS. 11, 12 and 13 are plan views showing alternate mounting configurations for a window covering device which is installed without a rubber gasket.
Figure 12:
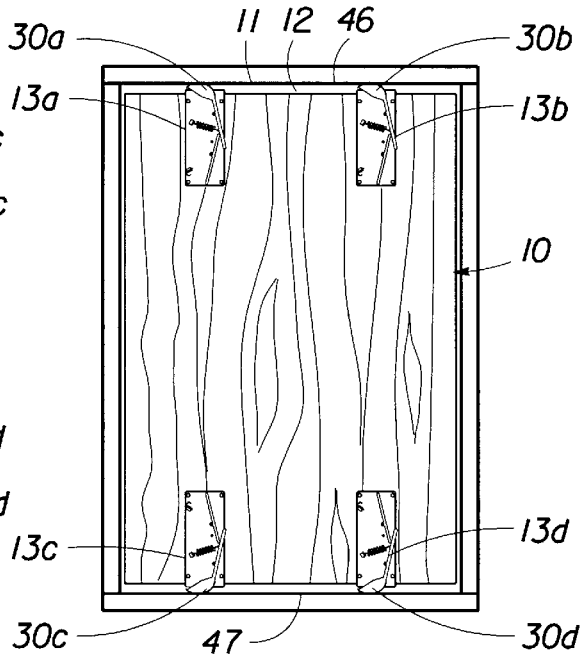
Figure 13:
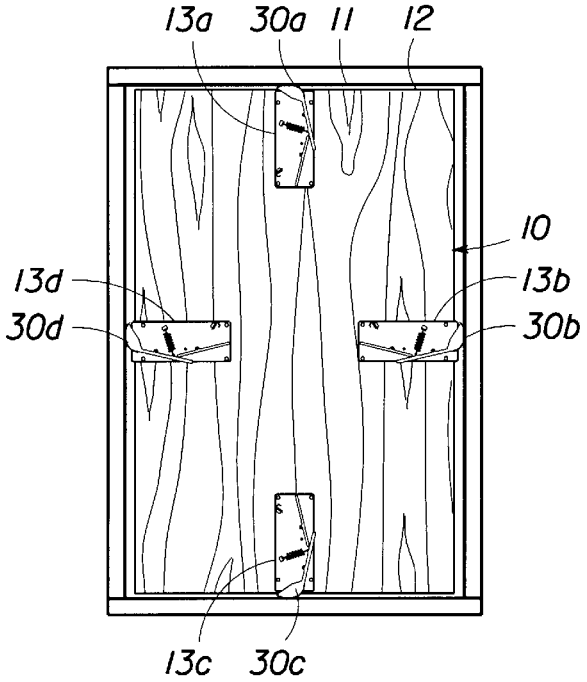

In FIGS. 11, 12, and 13, the window covering device is installed without using a gasket 14. Instead, two pairs of locking assemblies 13 are used.

In FIG. 11, locking assemblies 13*a*, 13*b* have been attached parallel to each other on the left side of wood panel 12, and locking assemblies 13*c*, 13*d* have been fastened parallel to each other on the right side of wood panel 12. The window covering device 10 is arranged inside window frame 11, and the rubber stoppers 30*a*, 30*b*, 30*c*, 30*d* of the locking assemblies 13*a*, 13*b*, 13*c*, 13*d* are pushed against the window frame 11, holding the window covering device 10 firmly in place.

In FIG. 12, locking assemblies 13*a*, 13*b* have been attached parallel to each other on the top portion of wood panel 12 and locking assemblies 13*c*, 13*d* have been fastened parallel to each other on the bottom portion of the wood panel 12. The window covering device 10 is arranged inside window frame 11, with the rubber stoppers 30*a*, 30*b* of locking assemblies 13*a*, 13*b* pushed against the head 46 of the frame, and the rubber stoppers 30*c*, 30*d* of locking assemblies 13*c*, 13*d* pushed against the sill 47 of the frame.

In FIG. 13, locking assemblies 13*a*, 13*b*, 13*c*, 13*d* have been fastened to wood panel 12, one at the midpoint of each side. The window covering device 10 is arranged inside window frame 11, and first rubber stoppers 30*a* and 30*c*, then rubber stoppers 30*b* and 30*d* hold it in place.

Figure 14:
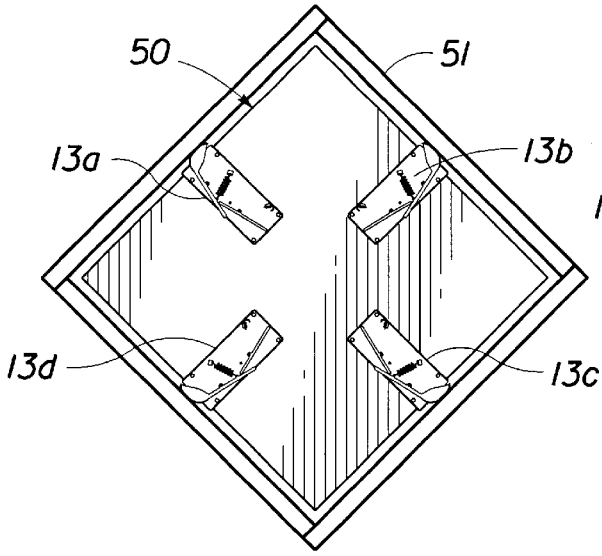
FIG. 14 is a plan view showing a window covering device constructed from metal for installation in a diamond-shaped window.
Figure 15:
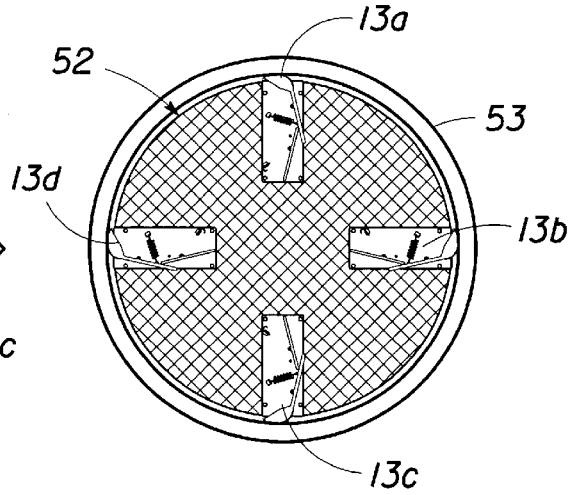
FIG. 15 is a plan view showing a window covering device constructed from expanded metal for installation in a round-shaped window.
Figure 16:
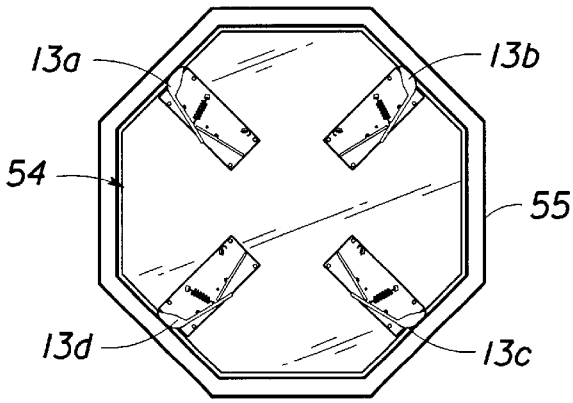
FIG. 16 is a plan view showing a window covering device constructed from plexiglass for installation in an octagonal-shaped window.

FIGS. 14, 15 and 16 show the wood covering device 10 constructed of different materials and used on odd-shaped windows. FIG. 13 shows a window covering device 50 constructed from a metal such as steel or aluminum for installation in a diamond-shaped window frame 51, using locking assemblies 13*a*, 13*b*, 13*c*, 13*d*. FIG. 14 shows a window covering device 52 constructed of expanded metal (grating) for installation in a round-shaped window frame 53, using locking assemblies 13*a*, 13*b*, 13*c*, 13*d*. FIG. 15 shows a window covering device 54 constructed of plexiglass (or urethane, or a similar material) for installation in an octagonal window frame 55, using locking assemblies 13*a*, 13*b*, 13*c*, 13*d*.

Figure 17:
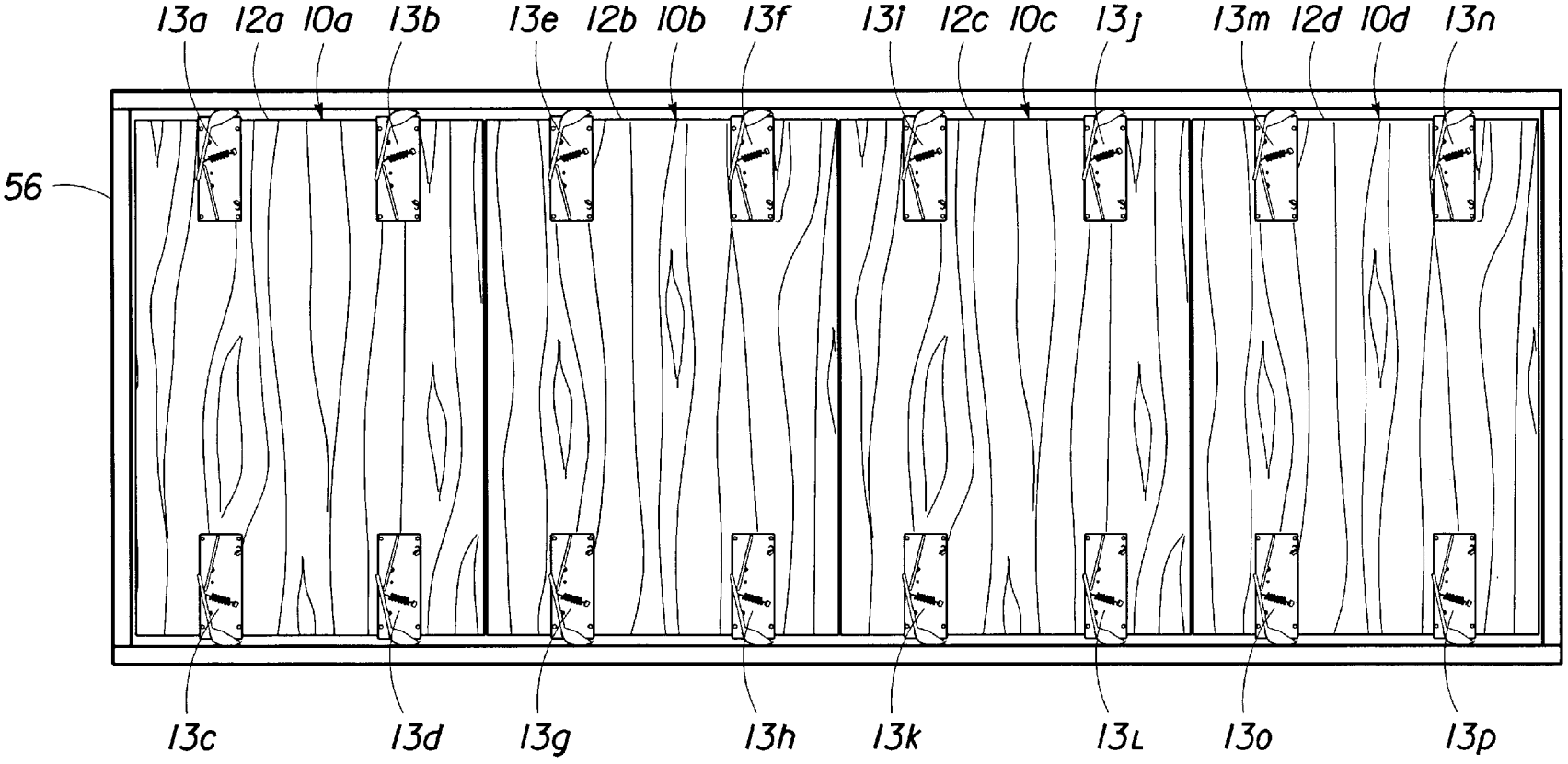
FIG. 17 is a plan view showing four window covering devices installed side by side in the frame of a large picture window.

Large picture windows or French doors present a large surface area to cover. To avoid the need to use a single, unwieldy piece of wood, several separate window covering devices can be installed adjacent to each other to completely cover the window. In FIG. 17, four window covering devices 10*a*, 10*b*, 10*c*, 10*d* have been arranged and installed adjacent to each other in a large window frame 56. Each has four locking assemblies arranged in parallel pairs of two on opposite sides of the wood panels 12*a*, 12*b*, 12*c*, 12*d*, for a total of sixteen locking assemblies 13*a*, 13*b*, 13*c*, 13*d*, 13*e*, 13*f*, 13*g*, 13*h*, 13*i*, 13*j*, 13*k*, 13*l*, 13*m*, 13*n*, 13*o*, 13*p*. Installation of each window covering device 10*a*, 10*b*, 10*c*, 10*d* is done individually, as described in FIG. 12 supra.

Figure 18:
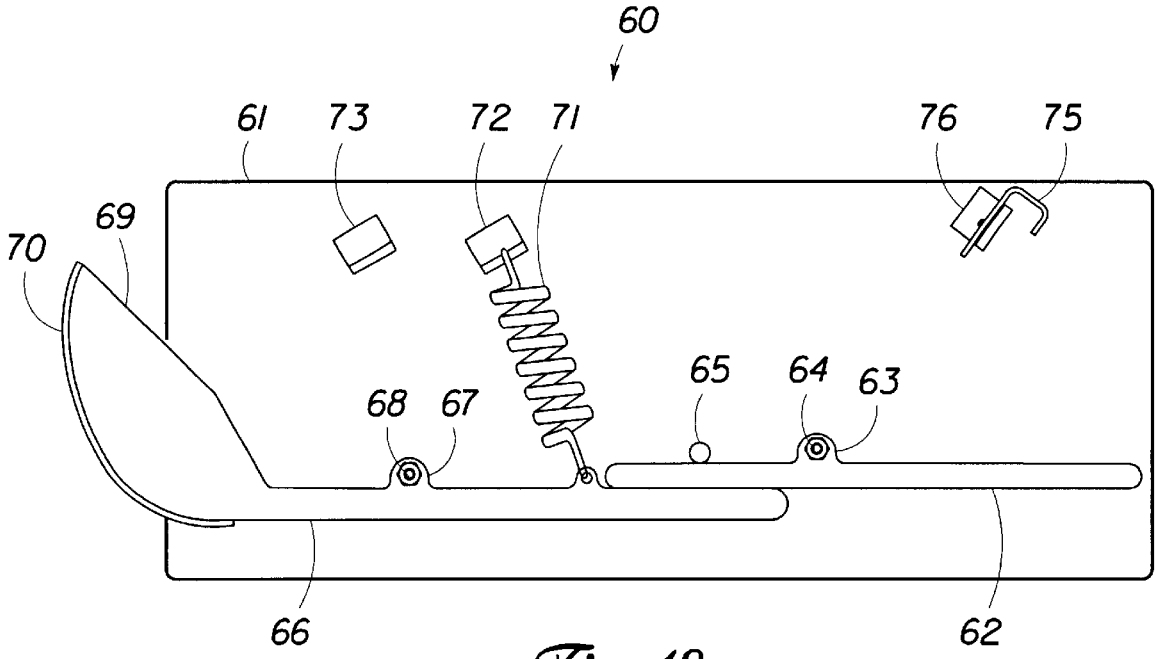
FIG. 18 is a top view of a single clip-on locking assembly.
Figure 19:
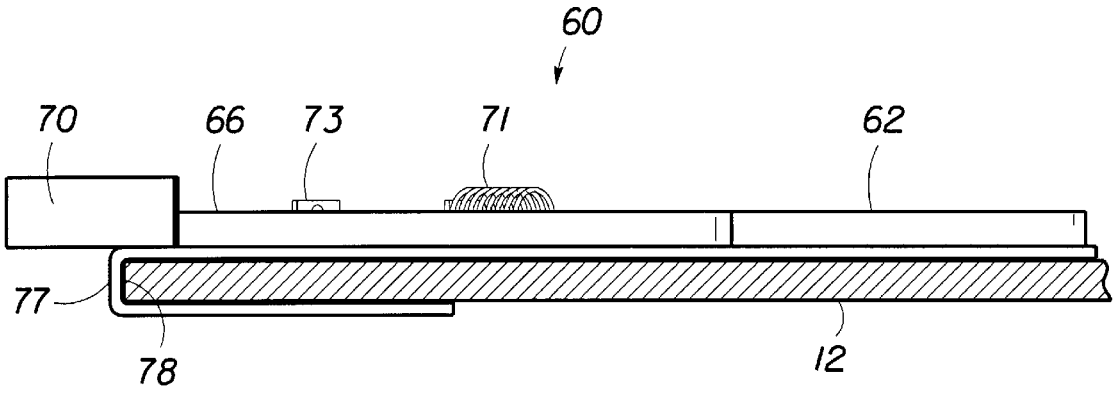
FIG. 19 is a side view of a single clip-on locking assembly installed on a wood panel.

FIGS. 18 and 19 show a clip-on locking assembly 60, which may be used in place of the locking assembly 13 shown in FIGS. 9 through 17.

As shown in FIG. 18, the clip-on locking assembly 60 comprises a metal base plate/bracket 61; a pivoting metal lever arm 62 mounted on the base plate 61 at lever arm pivot point 63 with a fastener 64; a lever arm stop 65 positioned to keep the lever arm 62 from pivoting past a desired point; and an angled metal locking arm 66 mounted on the base plate 61 at locking arm pivot point 67 with a fastener 68. Attached to the curved end 69 of locking arm 66 is a rubber stopper 70. One end of a spring 71 is attached to a first bracket 72. Alternate first bracket 73 provides a second attachment position for the end of the spring 71 if more spring-induced tension is needed. The opposite end of the spring 71 is attached to the locking arm 66 at attachment point 74. A metal catch 75 is pivotally mounted onto a second bracket 76.

As shown in FIG. 19, the u-shaped bracket end 77 of the metal base plate/bracket 61 has been pulled over the edge 75 of wood panel 12; no fasteners are used. Typically, two clip-on locking assemblies 60*a*, 60*b* are attached to one side of a wood panel 12 in a parallel relationship, as shown in FIGS. 9 and 10. Prior to installation, the end of the rubber stopper 70 is arranged to be even with the side of the u-shaped bracket end 77.

Figure 20:
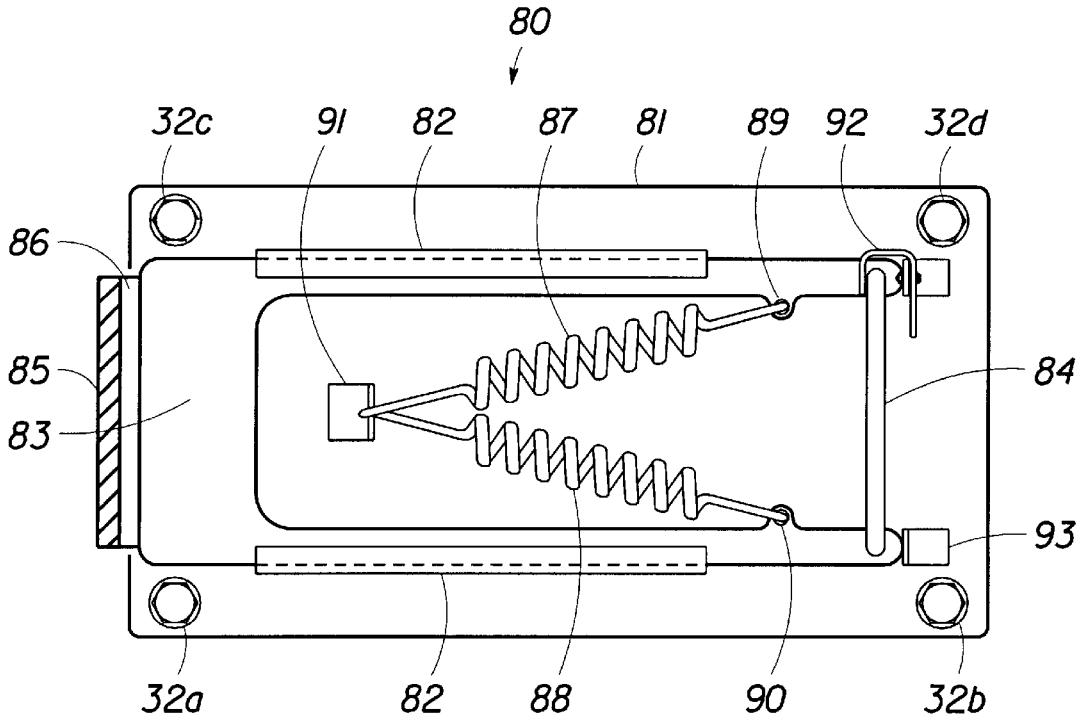
FIG. 20 is a top view of an alternate embodiment of the locking assembly with a metal slide and a guide on a base plate.
Figure 21:
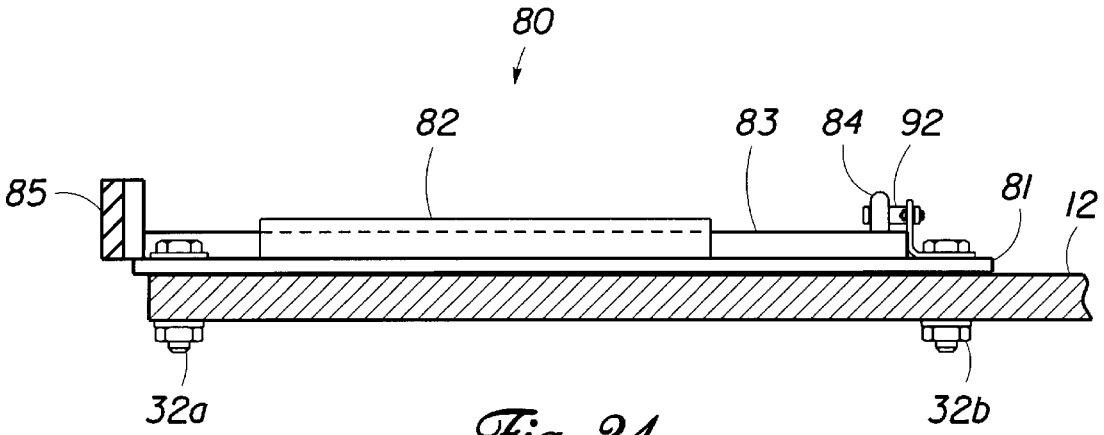
FIG. 21 is a side view of the alternate locking assembly installed on a wood panel.

In FIGS. 20 and 21, an alternate embodiment of the locking assembly 80 is disclosed. As shown in FIG. 20, the locking assembly 80 has a metal base plate 81 onto which a metal slide arm guide 82 has been welded. Inserted into the slide arm guide 82 is a flat, u-shaped metal slide arm 83 with an upturned handle 84 attached to the open ends of the "u", and a rubber stop 85 attached to a backing plate 86 on the opposite end of the "u", by means of strong adhesive or a rivet. An end of each of the two metal springs 87, 88, has been attached to one of the attachment points 89, 90 on the metal slide arm 83. (As shown in the figure, the attachment points 89, 90 can be small openings for insertion of a curved end of each spring 87, 88). The opposite end of each spring 87, 88 is attached to a metal bracket 91, which is welded onto the base plate 81. As shown in the figure, springs 87, 88 are stretched, and the handle 84 is held in a stationary position by a pivotable metal catch 92. A stop bracket 93 prevents movement of the slide arm 83 which might overextend the springs 87, 88.

FIG. 21 is a side view of the locking assembly 80, with the base plate 81 bolted to a wood panel 12. In operation, the window covering device 10 is inserted within a window frame 11. The catch 92 is pivoted, releasing the handle 84 and allowing spring-induced movement of the slide arm 83 through the slide arm guide 82. The rubber stop 85 will press against the window frame 11, and the window covering device 10 is held in place by spring tension.

I claim:

1. A device for installation within a frame of a window, said device comprising:

a rectangular panel sized to fit in said frame, the panel having a first side, a second side, a third side, and a fourth side, each of the sides having an edge;

a gasket affixed along the edge of the first side;

at least two holding mechanisms mounted at even intervals along the third side, each of said mechanisms having:

base plate;

lever arm with a first end and a second end, the lever arm pivotally mounted on the base plate;

stop mounted on the base plate, said stop preventing pivotal movement of the lever arm past a predetermined point;

locking arm with a first end having an attachment point and a curved second end, the locking arm pivotally mounted on the base plate, with the first end of the locking arm overlapping the second end of the lever arm;

stopper disposed on the second end of the locking arm;

spring with a first end and a second end, the first end attached to a bracket mounted on the base plate, and the second end attached to the attachment point on the locking arm; and catch mounted on the base plate, said catch rotatable between positions for holding the first end of the lever arm and releasing the first end of the lever arm;

the mechanism being movable between an unlocked and a locked position by the pivotal movement of the lever arm after the first end of the lever arm is released from the catch, allowing spring-induced pivotal movement of the locking arm.

2. The device of claim 1 wherein the panel has a small circular hole formed therein.

3. The device of claim 1 wherein the panel is made of material selected from the group comprising wood, metal, plexiglass and urethane.

4. A device for installation within a frame of a window, said device comprising:

a rectangular panel sized to fit in said frame, the panel having a first side, a second side, a third side, and a fourth side, each of the sides having an edge;

a gasket affixed along the edge of the first side;

at least two holding mechanisms arranged at even intervals along the third side, each of said mechanisms having:

a base plate with a u-shaped end, the mechanism being arranged by pulling the u-shaped end of the base plate over the edge of the third side of the panel;

a lever arm with a first end and a second end, the lever arm pivotally mounted on the base plate;

a stop mounted on the base plate, said stop preventing pivotal movement of the lever arm past a predetermined point;

a locking arm with a first end having an attachment point and a curved second end, the locking arm pivotally mounted on the base plate, with the first end of the locking arm overlapping the second end of the lever arm;

a stopper disposed on the second end of the locking arm;

a spring with a first end and a second end, the first end attached to a bracket mounted on the base plate, and the second end attached to the attachment point on the locking arm; and a catch mounted on the base plate, said catch rotatable between positions for holding the first end of the lever arm and releasing the first end of the lever arm;

the mechanism being movable between an unlocked and a locked position by the pivotal movement of the lever arm after the first end of the lever arm is released from the catch, allowing spring-induced pivotal movement of the locking arm.

5. The device of claim 4 wherein the panel has a small circular hole formed therein.

6. The device of claim 4 wherein the panel is made of material selected from the group comprising wood, metal, plexiglass and urethane.

7. A device for installation within a frame of a window, said device comprising:

a panel sized to fit in said frame, the panel having sides configured to complement the frame; and at least four holding mechanisms, each of which is mounted at the midpoint of each side, each of said mechanisms having:

a lever arm with a first end and a second end, the lever arm pivotally mounted on the base plate;

a stop mounted on the base plate, said stop preventing pivotal movement of the lever arm past a predetermined point;

a locking arm with a first end having an attachment point and a curved second end, the locking arm pivotally mounted on the base plate, with the first end of the locking arm overlapping the second end of the lever arm;

a stopper disposed on the second end of the locking arm;

a spring with a first end and a second end, the first end attached to a bracket mounted on the base plate, and the second end attached to the attachment point on the locking arm; and a catch mounted on the base plate, said catch rotatable between positions for holding the first end of the lever arm and releasing the first end of the lever arm; and the mechanism being movable between an unlocked and a locked position by the pivotal movement of the lever arm after the first end of the lever arm is released from the catch, allowing spring-induced pivotal movement of the locking arm.

8. The device of claim 7 wherein the panel has a small circular hole formed therein.

9. The device of claim 7 wherein the panel is made of material selected from the group comprising wood, metal, plexiglass and urethane.

10. A device for installation within a frame of a window, said device comprising:

a panel sized to fit in said frame, the panel having sides configured to complement the frame;

at least four holding mechanisms, each of which is arranged at the midpoint of each side, each of said mechanism having:

a base plate with a u-shaped end, the mechanism being arranged by pulling the u-shaped end of the base plate over a side of the panel;

a lever arm with a first end and a second end, the lever arm pivotally mounted on the base plate;

a stop mounted on the base plate, said stop preventing pivotal movement of the lever arm past a predetermined point;

a locking arm with a first end having an attachment point and a curved second end, the locking arm pivotally mounted on the base plate, with the first end of the locking arm overlapping the second end of the lever arm;

a stopper disposed on the second end of the locking arm;

a spring with a first end and a second end, the first end attached to a bracket mounted on the base plate, and the second end attached to the attachment point on the locking arm; and a catch mounted on the base plate, said catch rotatable between positions for holding the first end of the lever arm and releasing the first end of the lever arm;

the mechanism being movable between an unlocked and a locked position by the pivotal movement of the lever arm after the first end of the lever arm is released from the catch, allowing spring-induced pivotal movement of the locking arm.

11. The device of claim 10 wherein the panel has a small circular hole formed therein.

12. The device of claim 10 wherein the panel is made of material selected from the group comprising wood, metal, plexiglass and urethane.

13. A device for installation within a frame of a window, said device comprising:

a rectangular panel sized to fit in said frame, the panel having a first side, a second side, a third side, and a fourth side, each of the sides having an edge;

a gasket affixed along the edge of the first side;

at least two holding mechanisms mounted at even intervals along the third side, each of said mechanisms having:

a base plate with a guide;

a u-shaped slide arm with a first end and an open second end having a handle perpendicularly disposed thereto, and further having two sides, each having an attachment point, the slide arm disposed in the guide;

a stopper disposed on the first end of the slide arm;

a bracket mounted on the base plate, the bracket having an attachment point;

two springs, each having a first end and a second end, the first end of each spring being attached to the attachment point on the bracket, and the second end of each spring being attached to one of the attachment points on the sides of the slide arm;

a catch mounted on the base plate, said catch rotatable between positions for holding the handle and releasing the handle;

the mechanism being movable between an unlocked and a locked position by the spring-induced movement of the slide arm after the handle is released from the catch.

14. The device of claim 13 wherein the panel has a small circular hole formed therein.

15. The device of claim 13 wherein the panel is made of material selected from the group comprising wood, metal, plexiglass and urethane.

* * * * *